US012747887B2

(12) United States Patent
Sugisaki et al.

(10) Patent No.: US 12,747,887 B2
(45) Date of Patent: Sep. 29, 2026

(54) AIR CONDITIONING SYSTEM, FLOOR BLOWING AIR CONDITIONER, CONTROL METHOD, AND STORAGE MEDIUM

(71) Applicant: Carrier Japan Corporation, Tokyo (JP)

(72) Inventors: Satoko Sugisaki, Fuji (JP); Keiko Kanagawa, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 98 days.

(21) Appl. No.: 18/481,328

(22) Filed: Oct. 5, 2023

(65) Prior Publication Data

US 2024/0044544 A1 Feb. 8, 2024

Related U.S. Application Data

(63) Continuation of application No. PCT/JP2021/015024, filed on Apr. 9, 2021.

(51) Int. Cl.

| | |
|---|---|
| ***F24F 11/80*** | (2018.01) |
| ***F24F 1/0053*** | (2019.01) |
| ***F24F 13/02*** | (2006.01) |
| *F24F 11/65* | (2018.01) |
| *F24F 110/10* | (2018.01) |

(52) U.S. Cl.

CPC ..... *F24F 13/0227* (2013.01); *F24F 1/0053* (2019.02); *F24F 11/80* (2018.01); *F24F 11/65* (2018.01); *F24F 2110/10* (2018.01); *F24F 2221/40* (2013.01)

(58) Field of Classification Search

CPC ..... F24F 1/0053; F24F 11/80; F24F 2221/40

See application file for complete search history.

(56) References Cited

U.S. PATENT DOCUMENTS 4,931,948 A * 6/1990 Parker ..... F24F 11/88 236/1 C
2004/0261435 A1* 12/2004 Chen ..... F25B 9/008 62/190

(Continued)

FOREIGN PATENT DOCUMENTS

CN 110637198 A 12/2019
CN 111771089 A 10/2020

(Continued)

OTHER PUBLICATIONS

International Search Report issued May 25, 2021 in PCT/JP2021/015024 filed on Apr. 9, 2021, 2 pages.

(Continued)

*Primary Examiner* — Jerry-Daryl Fletcher
*Assistant Examiner* — Daniel C Comings
(74) *Attorney, Agent, or Firm* — Oblon, McClelland, Maier & Neustadt, L.L.P.

(57) ABSTRACT

An air conditioning system of the embodiment includes a first indoor unit and a second indoor unit. The first indoor unit controls a temperature of the inside of a space by controlling blowing of warm air from an upper part of the space to the inside of the space. The second indoor unit controls blowing of warm air from under a floor of the space to the inside of the space on the basis of a temperature in a lower part of the space.

8 Claims, 6 Drawing Sheets

(56) References Cited

U.S. PATENT DOCUMENTS

| | | | | |
|---|---|---|---|---|
| 2011/0113800 | A1* | 5/2011 | Sekiya | B60L 1/02 62/430 |
| 2012/0288363 | A1* | 11/2012 | Yumoto | F24F 1/0047 415/182.1 |
| 2015/0219382 | A1* | 8/2015 | Uselton | F24F 11/76 454/258 |
| 2021/0102716 | A1* | 4/2021 | Ito | F24F 3/153 |
| 2021/0215369 | A1* | 7/2021 | Kurihara | F24F 11/52 |

FOREIGN PATENT DOCUMENTS

| | | | | |
|---|---|---|---|---|
| JP | 6-174262 | A | 6/1994 | |
| JP | 3263324 | B2 | 3/2002 | |
| JP | 2002-310450 | A | 10/2002 | |
| JP | 2004-245552 | A | 9/2004 | |
| JP | 2005-201601 | A | 7/2005 | |
| JP | 2009-174726 | A | 8/2009 | |
| JP | 2009264702 | A * | 11/2009 | |
| JP | 2017-25522 | A | 2/2017 | |
| JP | 2018-48784 | A | 3/2018 | |
| WO | WO-2019167222 | A1 * | 9/2019 | G05B 15/02 |

OTHER PUBLICATIONS

Extended European Search Report Issued Jan. 3, 2025 in European Patent Application 21936056.7, 12 pages.

Office Action dated Mar. 28, 2026 issued in corresponding Chinese patent application No. 202180096742.7 (with English translation) (citing documents 1-5).

* cited by examiner

AIR CONDITIONING SYSTEM, FLOOR BLOWING AIR CONDITIONER, CONTROL METHOD, AND STORAGE MEDIUM

CROSS-REFERENCE TO RELATED APPLICATION

This application is a continuation of International Application No. PCT/JP2021/015024, filed Apr. 9, 2021, the entire content of which is incorporated herein by reference.

FIELD

The present invention relates to an air conditioning system, a floor blowing air conditioner, a control method, and a storage medium.

BACKGROUND

As comfortable thermal environmental conditions, the international organization for standardization (ISO) and the American Society of Heating, Refrigerating and Air-Conditioning Engineers (ASHREA) recommend an environment in which a temperature around the feet is not lower than a temperature around the head by more than 3 [° C.]. However, in actual dwelling spaces and office spaces, a temperature difference between a region around the head and a region around the feet (hereinafter referred to as an "upper and lower temperature difference") often exceeds the recommended range of 3 [° C.]. For example, in an office space in wintertime, when the upper and lower temperature difference is large and a temperature around the feet is relatively too low, a person in the room may feel uncomfortable due to coldness. In such a case, the person in the room may change a set temperature of the air conditioner to a higher temperature. A change to a higher set temperature in such an environment causes a state of an excessive heating operation and serves as a factor of waste of energy.

Conventionally, as a technology for improving comfort by reducing an upper and lower temperature difference in a space, for example, there is a technology described in Japanese Patent No. 3263324 (hereinafter referred to as a "Patent Literature"). The air conditioning system described in Patent Literature controls a floor blowing air conditioner that blows air-conditioned air upward from a plurality of floor blowing outlets provided on a floor of a living room, and a perimeter air conditioner that blows air-conditioned air along a window provided on a side wall in cooperation with each other using a control device. With such a configuration, the air conditioning system described in Patent Literature increases a cooling output of the perimeter air conditioner according to a rise in temperature inside the living room, and thereby reduces a cooling output of the floor blowing air conditioner to reduce an upper and lower temperature difference in the living room.

As described above, the air conditioning system described in Patent Literature is an air conditioning system for the purpose of cooling the inside of a living room. However, it is during heating, not during cooling, that combined use of, for example, the floor blowing air conditioner in addition to the air conditioner that controls a temperature of the entire space yields a large effect of improving comfort. This is because, during cooling, even if cold air is blown out from an upper part of the space, it will naturally flow to a lower part of the space, and occurrence of a large upper and lower temperature difference inside the space can be curbed to some extent without using the floor blowing air conditioner.

Also, in the air conditioning system described in Patent Literature, use of an air conditioner of a central air conditioning system (central heat source system) is assumed as the floor blowing air conditioner, and use of an air conditioner of a cold/hot water circulation system or a built-in heat pump system is assumed as the perimeter air conditioner. Such a system having air conditioners with different air conditioning systems combined thereto requires a large-scale system construction, and thus there is a problem in that the system cannot be easily introduced.

DETAILED DESCRIPTION

Hereinafter, an air conditioning system, a floor blowing air conditioner, a control method, and a storage medium of an embodiment will be described with reference to the drawings.

An air conditioning system of the embodiment includes a first indoor unit and a second indoor unit. The first indoor unit controls a temperature of the inside of a space by controlling blowing of warm air from an upper part of the space to the inside of the space. The second indoor unit controls blowing of warm air from under a floor of the space to the inside of the space on the basis of a temperature in a lower part of the space.

Figure 1:
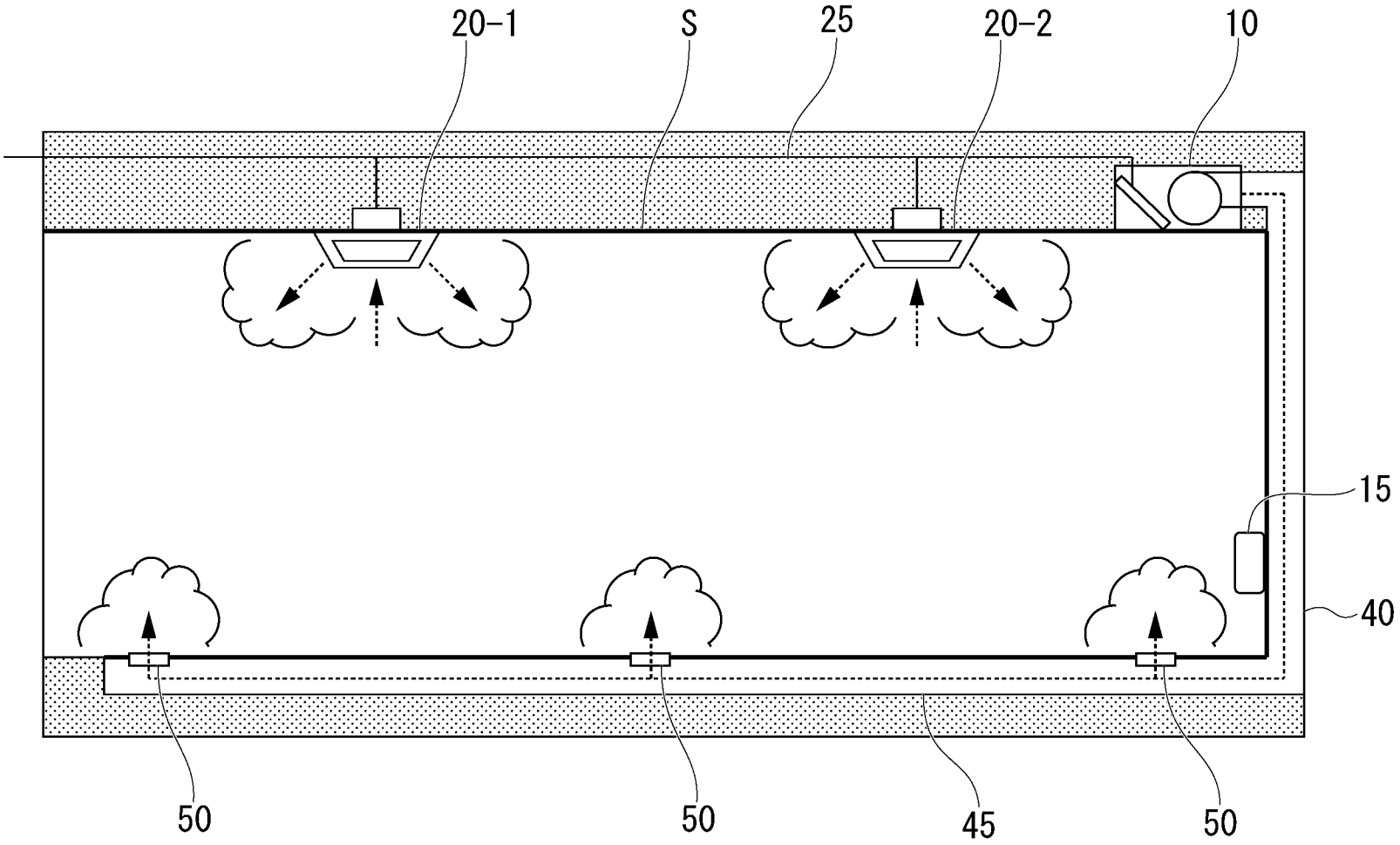
FIG. 1 is a schematic view for explaining an overview of air conditioning control by an air conditioning system 1 of the embodiment.

Hereinafter, a configuration of an air conditioning system 1 according to the embodiment will be described. FIG. 1 is a schematic view for explaining an overview of air conditioning control by the air conditioning system 1 of the embodiment.

FIG. 1 shows a vertical cross-sectional view of a portion of a building having a space S. The building is, for example, an office building, and the space S is a space in which people are active such as, for example, an office space. However, the building may be, for example, a house, and the space S may be a space in which people reside, such as a dwelling space. The air conditioning system 1 of the embodiment is a system for conditioning air inside the space S. The air conditioning system 1 is a system having a floor blowing air conditioner and a ceiling blowing air conditioner combined thereto.

An indoor unit (hereinafter referred to as a "floor blowing indoor unit 10") of the floor blowing air conditioner is installed above the ceiling of the space S. A remote thermosensor 15 is installed on a side wall inside the space S. Two indoor units (hereinafter referred to as a "ceiling blowing indoor unit 20-1" and a "ceiling blowing indoor unit 20-2") of the ceiling blowing air conditioner are installed on the ceiling of the space S. Hereinafter, the ceiling blowing indoor unit 20-1 and the ceiling blowing indoor unit 20-2 will be simply referred to as a "ceiling blowing indoor unit 20" when they do not need to be distinguished from each other.

A vertical duct 40 is installed outside the space S along the side wall. A floor of the space S is a double floor and functions as an underfloor air supply chamber 45. Furthermore, a horizontal duct may be used instead of the underfloor air supply chamber 45. Three blowing outlets 50 are provided on a floor of the space S. Air in the underfloor air supply chamber 45 can move into the space S through the blowing outlets 50.

Furthermore, the number of blowing outlets 50 is not limited to three, and may be any number of at least one. Furthermore, it is desirable that the blowing outlets 50 be provided with in appropriate number, positions, and intervals so that a temperature particularly at a position on a lower part of the space S is made uniform. Furthermore, an outdoor unit 30 shown in FIG. 2 to be described later is installed outside the space S.

The air conditioning system 1 of the present embodiment is a multi-type air conditioning system in which one floor blowing indoor unit 10, two ceiling blowing indoor units 20, and one outdoor unit 30 are connected via a refrigerant pipe 35 (connecting pipe). Furthermore, the number of the floor blowing indoor units 10 and the number of the ceiling blowing indoor units 20 are not limited to the above-described numbers, and may each be any number of at least one unit or more. It is desirable that the ceiling blowing indoor units 20 be provided at an appropriate number, positions, and intervals so that a temperature particularly at a position on an upper part of the space S is made uniform.

The refrigerant pipe 35 is a pipe for allowing a refrigerant to flow back and forth between the floor blowing indoor unit 10 and the ceiling blowing indoor units 20, and the outdoor unit 30. The refrigerant pipe 35 connects the floor blowing indoor unit 10, the ceiling blowing indoor unit 20-1, and the ceiling blowing indoor unit 20-2 in parallel. The floor blowing indoor unit 10 and the ceiling blowing indoor units 20, and the outdoor unit 30 are connected by the refrigerant pipe 35 to form a refrigeration cycle in which the refrigerant is circulated.

As described above, the air conditioning system 1 has a configuration in which both the floor blowing indoor unit 10 and the ceiling blowing indoor units 20 are used. Also, as it is apparent from the fact that the floor blowing indoor unit 10 and the ceiling blowing indoor units 20 are connected to the same outdoor unit 30, the floor blowing indoor unit 10 and the ceiling blowing indoor units 20 are indoor units of the air conditioner of the same air conditioning system. However, the floor blowing indoor unit 10 and the ceiling blowing indoor units 20 are not limited to being connected to the same outdoor unit 30. A configuration in which, for example, the outdoor unit 30 connected to the floor blowing indoor unit 10 and the outdoor unit 30 connected to the ceiling blowing indoor units 20 are installed separately may be used.

Generally, when heating is performed only by the ceiling blowing indoor units 20, a temperature in the lower part of the space S is relatively lower than a temperature in the upper part. Therefore, a person in the room may feel uncomfortable with the cold due to the relatively low temperature around his or her feet, and may change a set temperature of the air conditioner to a higher temperature. A change to a higher set temperature in such an environment causes a state of an excessive heating operation and causes waste of energy.

The air conditioning system 1 of the present embodiment can further reduce an upper and lower temperature difference inside the space S by using the floor blowing air conditioner in addition to the ceiling blowing air conditioner in combination. Therefore, since the temperature around the feet of the person in the room becomes relatively higher, the person in the room feels comfortable even if the temperature in the upper part inside the space S is a lower temperature. As described above, according to the air conditioning system 1, the set temperature of the air conditioning system 1 can be lowered without impairing comfort, and thereby energy consumption is reduced.

As shown in FIG. 1, air discharged from the floor blowing indoor unit 10 is first discharged to the vertical duct 40. The air discharged to the vertical duct 40 is further discharged to the underfloor air supply chamber 45 which is a double-floor space to which the vertical duct 40 is connected. The air discharged to the underfloor air supply chamber 45 is further blown into the space S from the three blowing outlets 50 provided on the floor of the space S. The floor blowing indoor unit 10 controls a blowing temperature of the air blown out from the blowing outlets 50 on the basis of a temperature measured by the remote thermo-sensor 15.

The remote thermo-sensor 15 is a sensor that measures a temperature at a position in the lower part of the space S (hereinafter referred to as a "lower part temperature"). The remote thermo-sensor 15 is installed at a position in a lower part of the side wall in the space S. In the present embodiment, the remote thermo-sensor 15 is installed at a position at a height of 30 [cm] above the floor. The remote thermo-sensor 15 is configured to be able to transmit a signal to the floor blowing indoor unit 10. The remote thermo-sensor 15 transmits a signal indicating a measured lower part temperature to the floor blowing indoor unit 10. Therefore, the floor blowing indoor unit 10 can recognize the lower part temperature of the space S, and control a blowing temperature of the air to be blown into the space S from the blowing outlets 50 on the basis of the lower part temperature.

Furthermore, in the present embodiment, the remote thermo-sensor 15 has been configured to be installed on the side wall in the space S, but is not limited thereto. The remote thermo-sensor 15 can be installed at any position as long as it is a position at which the lower part temperature of the space S can be measured. For example, a supporting column having a height of 30 [cm] placed at a center inside the space S may be installed, and the remote thermo-sensor 15 may be installed on a top of the supporting column.

Also, a plurality of remote thermo-sensors 15 may be installed in the space S. In this case, the floor blowing indoor unit 10 may control a blowing temperature of the air blown out from the blowing outlet 50 on the basis of, for example, an average value of the temperatures measured by the plurality of remote thermo-sensors 15.

The plurality of ceiling blowing indoor units 20 each include a suction temperature sensor 21 to be described later. The suction temperature sensor 21 is a sensor that measures a temperature of the air suctioned into each of the ceiling blowing indoor units 20 from the inside of the space S (hereinafter referred to as a "suction temperature"). The ceiling blowing indoor unit 20 estimates a temperature at a position in the upper part of the space S (hereinafter referred to as an "upper part temperature") on the basis of the temperature measured by the suction temperature sensor 21. In the present embodiment, the upper part temperature is a temperature at a position at a height of 120 [cm] above the floor in the space S. The ceiling blowing indoor unit 20 controls the upper part temperature of the space S on the basis of a set temperature set by a user.

Furthermore, the ceiling blowing indoor unit 20 recognizes in advance that, for example, the upper part temperature is lower than the suction temperature by a predetermined amount of temperature (for example, 2 [° C.]). The ceiling blowing indoor unit 20 estimates the upper part temperature by subtracting a value of the predetermined amount of temperature described above from the suction temperature measured by the suction temperature sensor 21.

Furthermore, the ceiling blowing indoor unit 20 may include a sensor capable of directly measuring the upper part temperature of the space S instead of the suction temperature sensor 21. In this case, the sensor measuring the upper part temperature may be installed, for example, at a position in an upper part of the side wall (for example, at a position at a height of 120 [cm] above the floor). That is, the temperature sensor provided in the ceiling blowing indoor unit 20 may be any sensor as long as it is a sensor capable of measuring or estimating the upper part temperature of the space S.

Figure 2:
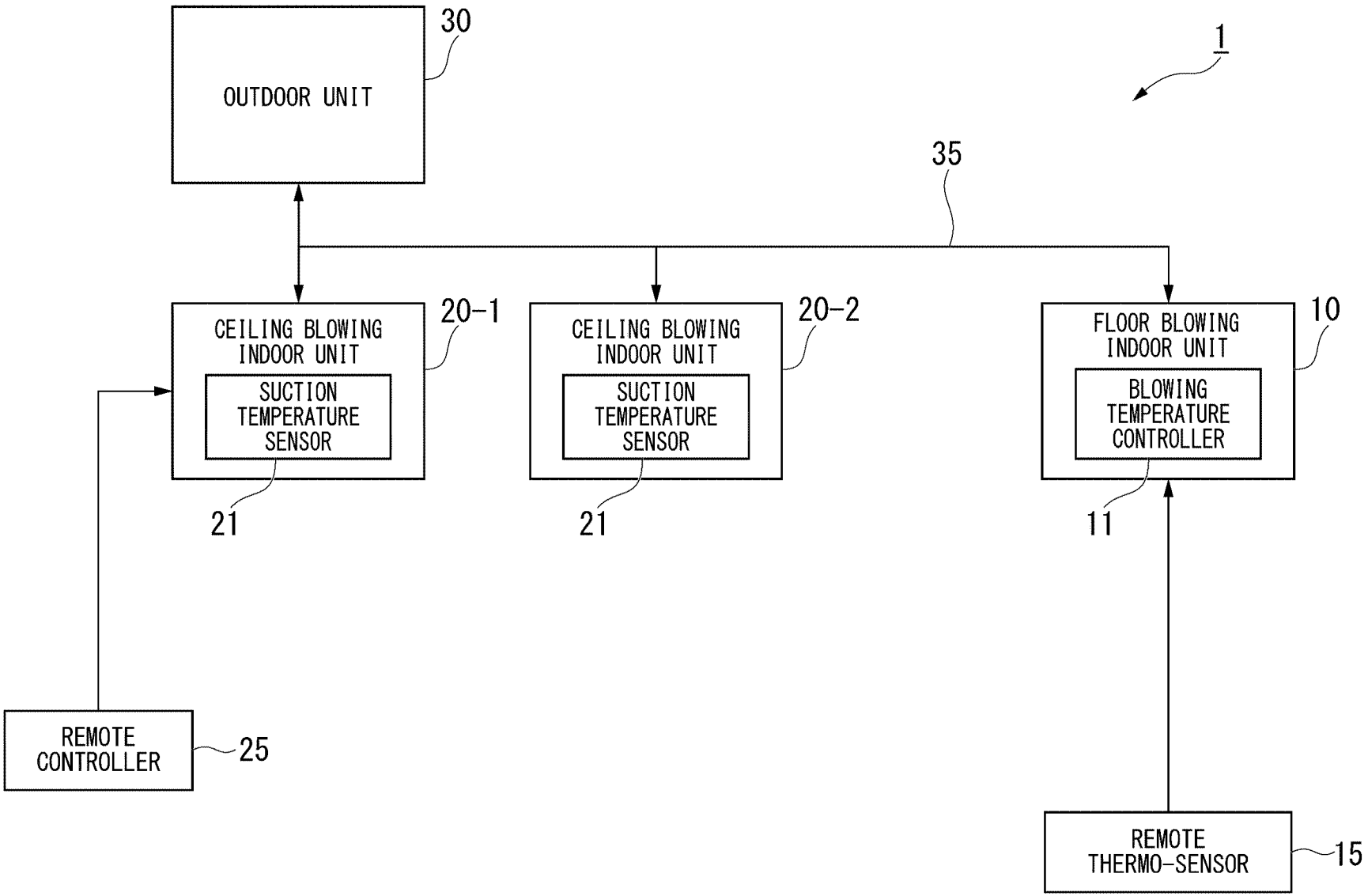
FIG. 2 is a block diagram showing an overall configuration of the air conditioning system 1 of the embodiment.

FIG. 2 is a block diagram showing an overall configuration of the air conditioning system 1 of the embodiment. As shown in FIG. 2, the air conditioning system 1 includes the floor blowing indoor unit 10, the remote thermo-sensor 15, the ceiling blowing indoor unit 20-1, the ceiling blowing indoor unit 20-2, a remote controller 25, the outdoor unit 30, and the refrigerant pipe 35.

The floor blowing indoor unit 10 and the ceiling blowing indoor units 20 each include, for example, an indoor heat exchanger, an indoor expansion valve, and an indoor blower, which are not shown in the drawings.

The indoor heat exchanger is, for example, a finned tube type heat exchanger. The indoor expansion valve is, for example, an electronic expansion valve (PMV). The indoor expansion valve can change (adjust) a degree of opening. For example, as the degree of opening of the indoor expansion valve increases, the refrigerant flows more easily in the indoor expansion valve. On the other hand, as the degree of opening of the indoor expansion valve decreases, it becomes more difficult for the refrigerant to flow in the indoor expansion valve. Specifically, the indoor heat exchanger includes a valve main body having a through hole formed therein, and a needle that can advance into and retreat from the through hole. When the through hole is closed with the needle, the refrigerant does not flow to the indoor heat exchanger. At this time, the indoor heat exchanger is in a closed state, and the degree of opening of the indoor heat exchanger is minimized. On the other hand, when the needle is farthest from the through hole, the refrigerant flows most easily into the indoor heat exchanger. At this time, the indoor heat exchanger is in an open state, and the degree of opening of the indoor heat exchanger is maximized.

The indoor heat exchanger and the indoor expansion valve are connected by the refrigerant pipe 35. Furthermore, as the refrigerant, for example, R410A, R32, or the like is used. A refrigerant oil or the like is included in the refrigerant.

The indoor blower is a blower having a centrifugal fan. Furthermore, a fan included in the indoor blower may be a fan of other structure such as, for example, an axial flow fan. The fan included in the indoor blower is disposed to face the indoor heat exchanger. Due to an operation of the fan of the indoor blower, the air in a space above the ceiling of the space S is suctioned into the floor blowing indoor unit 10, and the air inside the space S is suctioned into each of the ceiling blowing indoor units 20. The air suctioned into each of the floor blowing indoor unit 10 and the ceiling blowing indoor units 20 is heat-exchanged with the refrigerant by the indoor heat exchanger, and is discharged into the space S again by the operation of the fan.

As shown in FIG. 2, the floor blowing indoor unit 10 is configured to include a blowing temperature controller 11. The blowing temperature controller 11 sequentially acquires information indicating the lower part temperature of the space S that is periodically (for example, every 5 seconds) transmitted from the remote thermo-sensor 15. The blowing temperature controller 11 controls the blowing temperature of the air to be blown into the space S from the blowing outlet 50 according to the lower part temperature based on the acquired information. Furthermore, the blowing temperature controller 11 is configured in advance so that the blowing temperature of the air blown into the space S from the blowing outlet 50 can be controlled to a desired temperature.

For example, the blowing temperature controller 11 stores in advance a temperature of the air that is lowered while the air discharged from the floor blowing indoor unit 10 is blown into the space S from the blowing outlet 50. The blowing temperature controller 11 controls the indoor heat exchanger so that the air from the floor blowing indoor unit 10 is discharged to the vertical duct 40 at a temperature higher by an amount corresponding to the lowered temperature.

Furthermore, in the present embodiment, the blowing temperature controller 11 has been configured to be provided in the floor blowing indoor unit 10, but is not limited thereto. For example, the blowing temperature controller 11 may be provided in the outdoor unit 30 or may be provided in a control device (external device) which is not shown in the drawings.

The blowing temperature controller 11 includes, for example, a processor such as a central processing unit (CPU) connected via a bus, a memory, an auxiliary storage device, and the like. The blowing temperature controller 11 reads and executes a program from, for example, an auxiliary storage device. The auxiliary storage device is configured using a storage medium such as, for example, a magnetic hard disk device or a semiconductor storage device. For example, the auxiliary storage device is configured using a non-volatile memory such as an electrically erasable programmable read-only memory (EEPROM).

The program may be stored in a storage (a storage device including a non-transitory storage medium) in advance or may be stored in a removable storage medium (the non-transitory storage medium) such as a digital versatile disc (DVD) or a compact disc (CD)-read-only memory (ROM) and installed when the storage medium is mounted in a drive device.

Furthermore, all or part of the blowing temperature controller 11 may be realized by using hardware such as an application specific integrated circuit (ASIC), a programmable logic device (PLD), or a field programmable gate array (FPGA). The program may be recorded on a computer-readable recording medium. The above-described storage medium may be referred to as the recording medium. The computer-readable recording medium refers to a portable medium such as, for example, a flexible disk, a magneto-optical disk, a ROM, or a CD-ROM, and a storage device such as a hard disk incorporated in a computer system. The program may be transmitted via a telecommunication line.

The remote thermo-sensor 15 is a temperature sensor that measures the lower part temperature of the space S periodically (for example, every 5 seconds). As described above, in the present embodiment, the remote thermo-sensor 15 is installed at a position at a height of 30 [cm] above the floor, and measures a temperature at the position at the height of 30 [cm] above the floor in the space S. The remote thermo-sensor 15 periodically (for example, every 5 seconds) outputs a signal indicating the measured lower part temperature to the floor blowing indoor unit 10.

The floor blowing indoor unit 10 includes, for example, a signal input unit which is not shown in the drawings. The signal input unit receives an input of a signal output from the remote thermo-sensor 15 and outputs the signal to the blowing temperature controller 11. For example, the signal input unit is connected to be able to communicate with the remote thermo-sensor 15 via a communication interface such as RS-232C (Recommended Standard-232C), RS-422A (Recommended Standard-422A), RS-485 (Recommended Standard-485), or USB (Universal Serial Bus). The signal input unit receives a signal input via the communication interface. The signal input unit is connected to an internal bus, which is not shown in the drawings, and outputs the signal to the blowing temperature controller 11 via the internal bus.

Furthermore, the signal input unit may receive an input of a signal output from the remote thermo-sensor 15 and store data of the lower part temperature of the space S based on the signal in a storage medium such as, for example, an auxiliary storage device as sensor data. In this case, the blowing temperature controller 11 controls the blowing temperature of the air blown into the space S on the basis of the sensor data stored in the storage medium.

The remote controller 25 is an input interface that receives user's operation input regarding a setting of the air conditioning system 1. For example, the remote controller 25 receives an operation input instructing switching between ON and OFF of a power supply state of the air conditioning system 1. Alternatively, for example, the remote controller 25 receives an operation input that instructs a set temperature. In order to bring the inside of the space S into a desired temperature, the user operates the remote controller 25 and performs an operation input to instruct a temperature setting.

The remote controller 25 outputs the input instruction information to the ceiling blowing indoor unit 20-1. Furthermore, the remote controller 25 and the ceiling blowing indoor unit 20-1 may be connected by wire or wirelessly. The instruction information input to the ceiling blowing indoor unit 20-1 is further transmitted to the ceiling blowing indoor unit 20-2, the outdoor unit 30, and the floor blowing indoor unit 10 as well. Therefore, the air conditioning system 1 can control a temperature inside the space S, control switching between ON and OFF of the power supply state of the air conditioning system 1, and the like on the basis of the instruction information input from the remote controller 25.

Furthermore, a transmission means of the instruction information input from the remote controller 25 in the air conditioning system 1 is not limited to the above-described configuration. For example, it may be configured such that the instruction information input from the remote controller 25 is first transmitted to a control device (external device) which is not shown in the drawings, and further transmitted from the control device to the floor blowing indoor unit 10, each of the ceiling blowing indoor units 20, and the outdoor unit 30.

The blowing temperature controller 11 of the floor blowing indoor unit 10 controls the blowing temperature of the air to be blown into the space S from the blowing outlet 50 in different operation modes from each other depending on, for example, whether the air conditioning system 1 is at low load or at high load. Furthermore, details of the operation mode will be described in detail later.

In the present embodiment, in order to simplify the explanation, when the air conditioning system 1 is at high load means when the air conditioning system 1 is started. This is because, generally, when the system is started, it is assumed that there is often a state in which a difference between a set temperature set by the user and an actual temperature inside the space S is large, and a load on the air conditioning system 1 is in a state of relatively high.

Also, in the present embodiment, in order to simplify the explanation, when the air conditioning system 1 is at low load refers to a time other than when the air conditioning system 1 is started. This is because, generally, at the time other than when the system is started, it is assumed that there is often a state in which a difference between a set temperature and an actual temperature inside the space S is small, a load on the air conditioning system 1 is relatively small, and an operation is in a stable state.

However, the air conditioning system 1 being at high load and at low load are not limited to the above-described cases, and, for example, the term "at high load" may refer to a general state in which there is a large difference between the set temperature and the actual temperature inside the space S, and the term "at low load" may refer to a general state in which there is a small difference between the set temperature and the actual temperature inside the space S.

The blowing temperature controller 11 of the floor blowing indoor unit 10 performs a heating operation in a high-load mode, which will be described later, until the lower part temperature measured by the remote thermo-sensor 15 reaches the set temperature based on the information input from remote controller 25. The blowing temperature controller 11 stops the heating operation when the measured lower part temperature has reached the set temperature.

Also, after the heating operation has been stopped, the blowing temperature controller 11 resumes the heating operation in a low-load mode, which will be described later, when the measured lower part temperature has dropped by a predetermined amount of temperature. In the present embodiment, the blowing temperature controller 11 restarts the heating operation when the measured lower part temperature drops by 0.5 [° C.] from the set temperature.

As shown in FIG. 2, the ceiling blowing indoor unit 20 is configured to include the suction temperature sensor 21. As described above, the suction temperature sensor 21 measures the suction temperature of the air suctioned into the ceiling blowing indoor unit 20 from the inside of the space S. The ceiling blowing indoor unit 20 estimates the upper part temperature of the space S on the basis of the suction temperature measured by the suction temperature sensor 21.

The ceiling blowing indoor unit 20 performs a heating operation until the estimated upper part temperature reaches a temperature lower than the set temperature based on the information input from the remote controller 25 by a predetermined amount of temperature. The ceiling blowing indoor unit 20 stops the heating operation when the estimated upper part temperature has reached a temperature lower than the set temperature by a predetermined amount of temperature. Also, after the heating operation has been stopped, the ceiling blowing indoor unit 20 resumes the heating operation when the estimated upper part temperature has dropped by a predetermined amount of temperature.

In the present embodiment, the ceiling blowing indoor unit 20 stops the heating operation when the estimated upper part temperature has reached a temperature lower than the set temperature by 2 [° C.]. Thereafter, the ceiling blowing indoor unit 20 resumes the heating operation when the estimated upper part temperature has dropped by 0.5 [° C.] from the temperature lower than the set temperature by 2 [° C.] (that is, when the upper part temperature has reached a temperature lower than the set temperature by 2.5 [° ]).

The outdoor unit 30 includes, for example, an outdoor heat exchanger, a four-way valve, a compressor, an outdoor expansion valve, an outdoor blower, and an accumulator, which are not shown in the drawings. The refrigerant pipe 35 connects the outdoor expansion valve, the outdoor heat exchanger, the four-way valve, the compressor, and the accumulator.

The outdoor heat exchanger is, for example, a finned tube type heat exchanger. The four-way valve is a valve for switching a direction in which the refrigerant flows in the refrigerant pipe 35. The four-way valve switches a direction in which the refrigerant flows between a direction during a heating operation and a direction during a cooling operation (or during a defrosting operation) that is a direction opposite to the direction during the heating operation. However, the air conditioning system 1 in the present embodiment may be a dedicated air conditioning system for heating.

The compressor can change an operating frequency by a known inverter control. The compressor suctions the refrigerant through a suction port and compresses the refrigerant inside. The compressor discharges the compressed refrigerant to the outside through a discharge port. The accumulator is attached to the suction port of the compressor. The accumulator separates the refrigerant into a liquid refrigerant and a gas refrigerant, and stores the liquid refrigerant.

The outdoor expansion valve is configured similarly to the indoor expansion valve. The outdoor expansion valve is, for example, an electronic expansion valve (PMV). The outdoor expansion valve can change (adjust) a degree of opening. For example, as the degree of opening of the outdoor expansion valve increases, the refrigerant flows more easily through the outdoor expansion valve. On the other hand, as the degree of opening of the outdoor expansion valve decreases, it becomes more difficult for the refrigerant to flow through the outdoor expansion valve.

The outdoor blower is configured similarly to the indoor blower. The outdoor blower is a blower including an axial flow fan. Furthermore, a fan included in the indoor blower may be a fan of other structure such as, for example, a centrifugal fan. The fan included in the outdoor blower is disposed to face the outdoor heat exchanger.

Hereinafter, control of the blowing temperature by the blowing temperature controller 11 of the floor blowing indoor unit 10 in each operation mode will be described.

The blowing temperature controller 11 controls the blowing temperature on the basis of a preset upper limit temperature that is different according to the operation mode. The blowing temperature controller 11 sequentially controls the blowing temperature so that the blowing temperature does not exceed the upper limit temperature and reaches a temperature closer to the upper limit temperature. Hereinafter, an operation mode at high load (when the system is started) is referred to as a "high-load mode," and an operation mode at low load (at the time other than when the system is started) is referred to as a "low-load mode".

Figure 3:
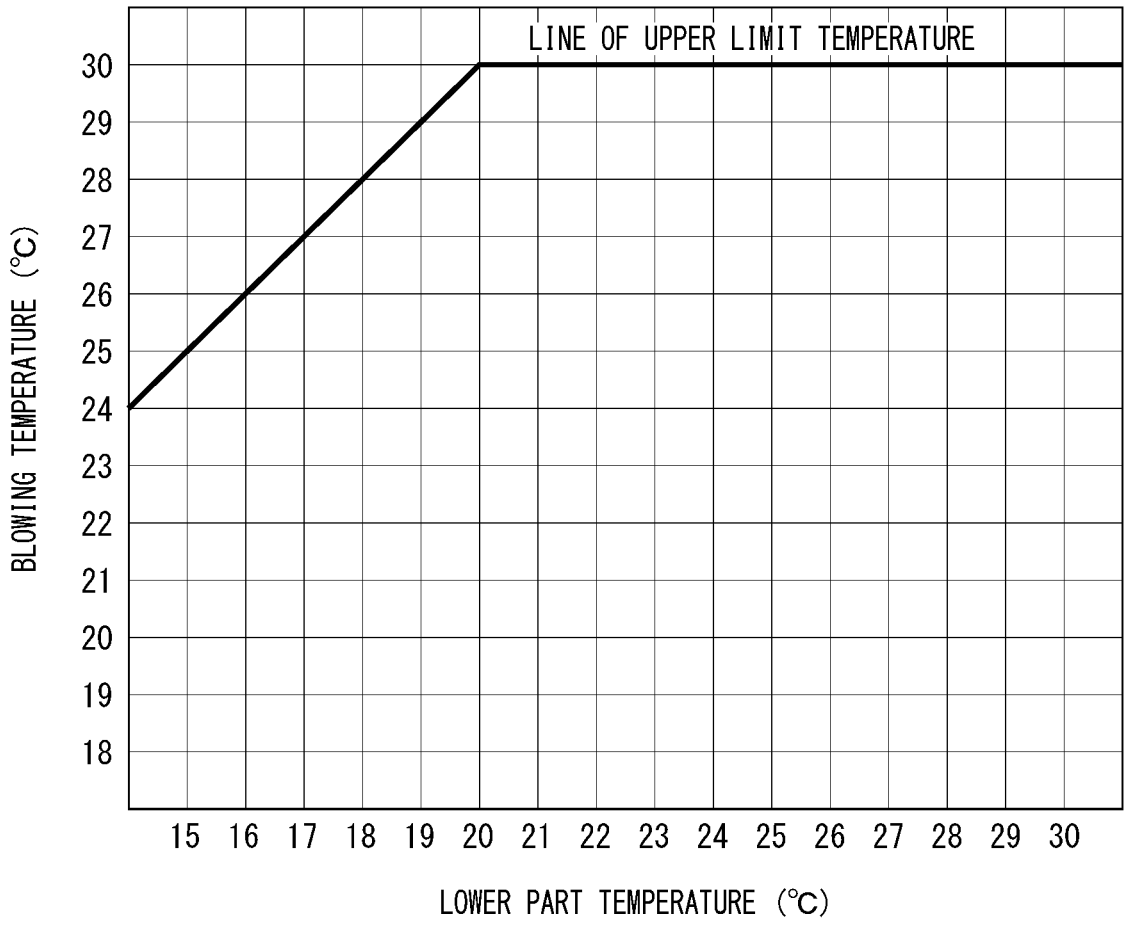
FIG. 3 is a diagram showing an example of an upper limit temperature of a blowing temperature in a high-load mode.

FIG. 3 is a diagram showing an example of the upper limit temperature of the blowing temperature in the high-load mode. In the graph shown in FIG. 3, the horizontal axis represents a lower part temperature of the space S measured by the remote thermo-sensor 15, and the vertical axis represents a blowing temperature of the air blown out from the blowing outlet 50 controlled by the blowing temperature controller 11. Furthermore, units of the lower part temperature and the blowing temperature shown in FIG. 3 are both Celsius (° C.).

As shown in FIG. 3, in the high-load mode, when the lower part temperature of the space S is 20 [° C.] or lower, the upper limit temperature of the blowing temperature is a temperature obtained by adding 10 [° C.] to the lower part temperature. Also, as shown in FIG. 3, in the high-load mode, when the lower part temperature of the space S is 20 [° C.] or higher, the upper limit temperature of the blowing temperature is a constant temperature of 30 [° C.].

Generally, a buoyancy effect occurs on the basis of a relationship between the lower part temperature and the blowing temperature, and warm air in the lower part of the space S may rise to the upper part of the space S. Therefore, reducing the upper and lower temperature difference inside the space S by raising the lower part temperature is hindered. The line of the upper limit temperature of the blowing temperature shown in FIG. 3 is an example of a line appropriately set to suppress rise of the warm air due to such a buoyancy effect.

That is, the line of the upper limit temperature of the blowing temperature shown in FIG. 3 is set in advance on the basis of general investigation results in which, when the lower part temperature is 20 [° C.] or lower, an influence of the buoyancy effect increases if the blowing temperature is higher than the lower part temperature by 10 [° C.] or higher. Also, the line of the upper limit temperature is set in advance on the basis of general investigation results in which, when the lower part temperature is 20 [° C.] or higher, an influence of the buoyancy effect increases if the blowing temperature is higher than 30 [° C.].

During an operation in the high-load mode, the blowing temperature controller 11 acquires information indicating the lower part temperature of the space S that is output periodically (for example, every 5 seconds) from the remote thermo-sensor 15. The blowing temperature controller 11 determines the upper limit temperature of the blowing temperature corresponding to the measured lower part temperature on the basis of the line of the upper limit temperature of the blowing temperature shown in FIG. 3.

Furthermore, information indicating the line of the upper limit temperature of the blowing temperature shown in FIG. 3 is stored in advance in, for example, the auxiliary storage device described above. The blowing temperature controller 11 sequentially controls the blowing temperature so that the blowing temperature does not exceed the determined upper limit temperature and reaches a temperature closer to the determined upper limit temperature.

The blowing temperature controller 11 stops the heating operation when the measured lower part temperature has reached the set temperature. Thereafter, when the measured lower part temperature drops by a predetermined amount of temperature (0.5 [° C.] in the present embodiment) from the set temperature, the blowing temperature controller 11 resumes the heating operation in the low-load mode.

Figure 4:
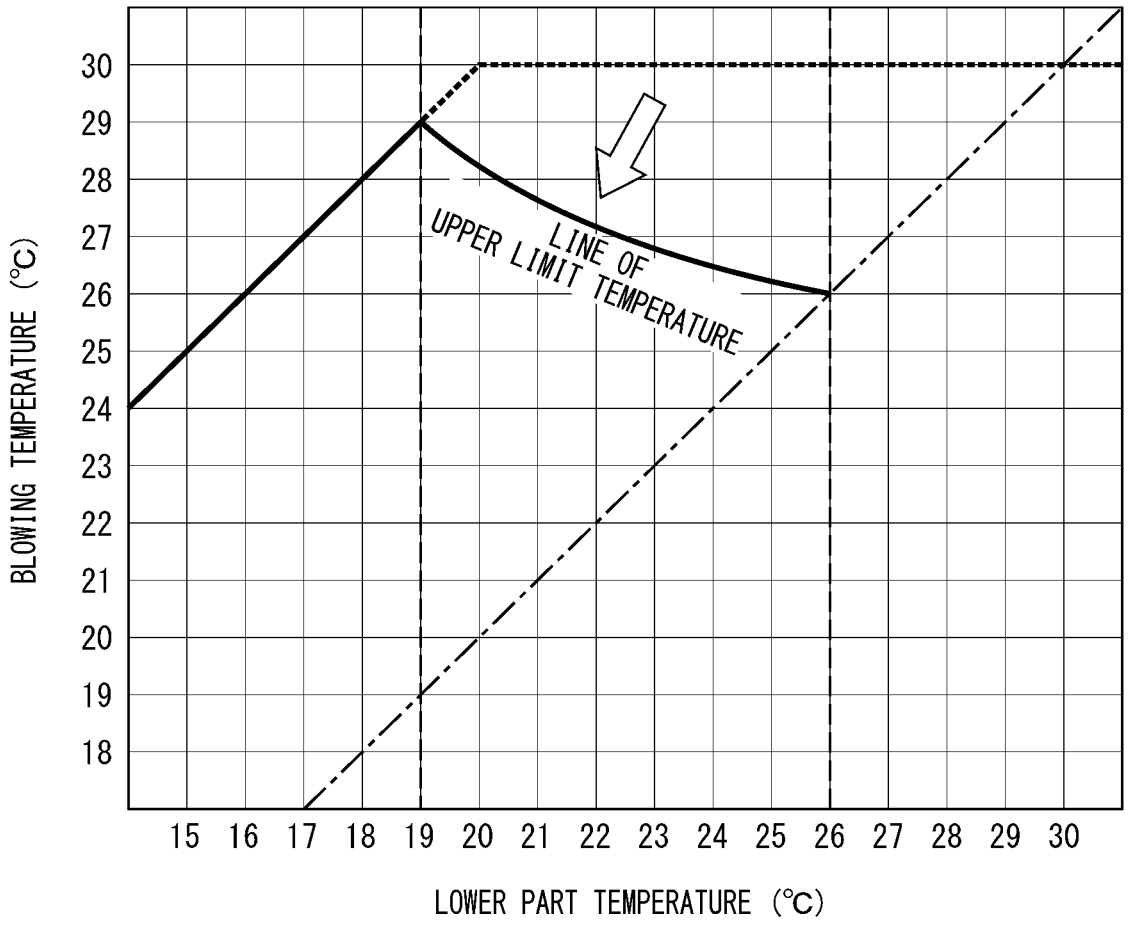
FIG. 4 is a diagram showing an example of an upper limit temperature of a blowing temperature in a low-load mode.

FIG. 4 is a diagram showing an example of the upper limit temperature of the blowing temperature in the low-load mode. Similarly to FIG. 3, in the graph shown in FIG. 4, the horizontal axis represents a lower part temperature of the space S measured by the remote thermo-sensor 15, and the vertical axis represents a blowing temperature of the air blown out from the blowing outlet 50 controlled by the blowing temperature controller 11. Furthermore, units of the lower part temperature and the blowing temperature shown in FIG. 4 are both Celsius (° C.).

As shown in FIG. 4, in the low-load mode, when the lower part temperature of the space S is 19 [° C.] or lower, the upper limit temperature of the blowing temperature is a temperature obtained by adding 10 [° C.] to the lower part temperature as in the high-load mode described above. On the other hand, in the low-load mode, when the lower part temperature of the space S is 19 [° C.] or higher, the control is performed with an upper limit temperature different from that in the high-load mode described above.

As shown in FIG. 4, when the lower part temperature of the space S is 19 [° C.] or higher, the upper limit temperature of the blowing temperature in the low-load mode is a temperature lower than the upper limit temperature of the blowing temperature in the above-described high-load mode shown in FIG. 3. As shown in the figure, the line of the upper limit temperature of the blowing temperature is a curved line in which an intersection of the lower part temperature of 19 [° C.] and the blowing temperature of 29 [° C.] and an intersection of the lower part temperature of 26 [° C.] and the blowing temperature of 26 [° C.] are included. This curved line is a line that draws a gentle curve so that the blowing temperatures are slightly lower than those on a straight line directly connecting the two intersections described above.

Furthermore, the curved line of the upper limit temperature of the blowing temperature is a line derived on the basis of field investigation. The curved line is an example of a line that is appropriately set so that the warm air blown up from the blowing outlet 50 does not make the person in the room feel that his or her face is hot.

Furthermore, the intersection of the lower part temperature of 19 [° C.] and the blowing temperature of 29 [° C.] is set on the basis of an intersection of a line of temperature in which the upper limit temperature of the blowing temperature is added to the lower part temperature by 10 [° C.] and a line of the lower part temperature of 19 [° C.]. Furthermore, the lower part temperature of 19 [° C.] is a temperature derived from field investigation and serving as a reference of a lower limit for not making the person in the room feel cold.

Furthermore, the intersection of the lower part temperature of 26 [° C.] and the blowing temperature of 26 [° C.] is set on the basis of an intersection of a line indicated by the dashed-dotted line in FIG. 4 in which the lower part temperature and the blowing temperature are isothermal and a line of the lower part temperature of 26 [° C.]. Furthermore, the lower part temperature of 26 [° C.] is a temperature derived from field investigation and serving as a reference of an upper limit for not making the person in the room feel hot.

The blowing temperature controller 11 acquires information indicating the lower part temperature of the space S that is output periodically (for example, every 5 seconds) from the remote thermo-sensor 15 during an operation in the low-load mode. The blowing temperature controller 11 determines the upper limit temperature of the blowing temperature corresponding to the measured lower part temperature on the basis of the line of the upper limit temperature of the blowing temperature shown in FIG. 4.

Furthermore, information indicating the line of the upper limit temperature of the blowing temperature shown in FIG. 4 is stored in advance in, for example, the auxiliary storage device described above. The blowing temperature controller 11 sequentially controls the blowing temperature so that the blowing temperature does not exceed the determined upper limit temperature and reaches a temperature closer to the determined upper limit temperature.

The blowing temperature controller 11 stops the heating operation when the measured lower part temperature has reached the set temperature. Thereafter, when the measured lower part temperature drops by a predetermined amount of temperature (0.5 [° C.] in the present embodiment) from the set temperature, the blowing temperature controller 11 resumes the heating operation in the low-load mode.

Figure 5:
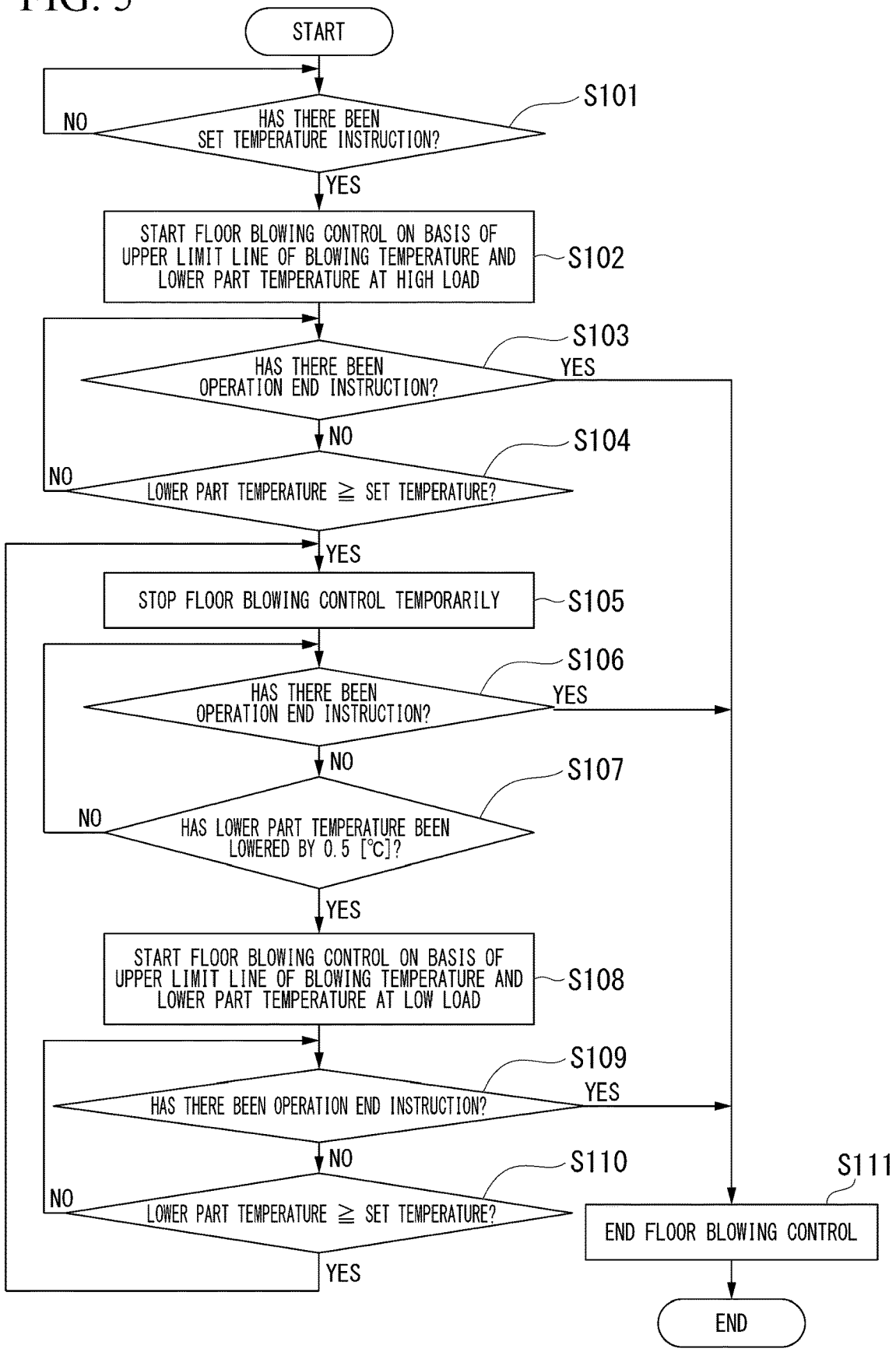
FIG. 5 is a flowchart showing an operation of a floor blowing indoor unit 10 of the embodiment.

An example of an operation of the floor blowing indoor unit 10 will be described below. FIG. 5 is a flowchart showing an operation of the floor blowing indoor unit 10 of the embodiment. The operation of the floor blowing indoor unit 10 shown in the flowchart of FIG. 5 is started when, for example, power of the air conditioning system 1 is turned on.

The blowing temperature controller 11 of the floor blowing indoor unit 10 waits for an input of information indicating a set temperature instruction (step S101). The set temperature instruction refers to an instruction received by an operation input of the user to the remote controller 25 for controlling the temperature inside the space S to a desired set temperature. The information indicating the set temperature instruction is, for example, output from the remote controller 25 and input to the floor blowing indoor unit 10 via the ceiling blowing indoor unit 20-1.

When the blowing temperature controller 11 receives an input of the information indicating the set temperature instruction (step S101, YES), the blowing temperature controller 11 starts floor blowing control in which the blowing temperature is sequentially controlled on the basis of, for example, the upper limit temperature of the blowing temperature corresponding to the lower part temperature of the space S during the heating operation in the high-load mode shown in FIG. 3 and the information indicating the lower part temperature of the space S periodically (for example, every 5 seconds) input from the remote thermo-sensor 15 (step S102).

Next, the blowing temperature controller 11 continues the floor blowing control in the high-load mode until the lower part temperature of the space S that is periodically (for example, every 5 seconds) input from the remote thermo-sensor 15 reaches the set temperature based on the information indicating the set temperature instruction (step S104).

In the meantime, if the blowing temperature controller 11 receives an input of information indicating an operation end instruction (step S103, YES), the blowing temperature controller 11 ends the floor blowing control (step S111). As described above, the operation of the floor blowing indoor unit 10 shown in the flowchart of FIG. 5 ends. The operation end instruction refers to, for example, an instruction received by an operation input of the user to the remote controller 25 for turning off power of the air conditioning system 1.

When the lower part temperature of the space S that is periodically (for example, every 5 seconds) input from the remote thermo-sensor 15 has reached the set temperature (step S104, YES), the blowing temperature controller 11 temporarily stops the floor blowing control (step S105).

Next, the blowing temperature controller 11 maintains a state in which the floor blowing control is temporarily stopped until the lower part temperature of the space S that is periodically (for example, every 5 seconds) input from the remote thermo-sensor 15 becomes lower than the set temperature by 0.5 [° C.] (step S107).

In the meantime, if the blowing temperature controller 11 receives an input of the information indicating the operation end instruction (step S106, YES), the blowing temperature controller 11 ends the floor blowing control (step S111). As described above, the operation of the floor blowing indoor unit 10 shown in the flowchart of FIG. 5 ends.

When the lower part temperature of the space S that is periodically (for example, every 5 seconds) input from the remote thermo-sensor 15 has become lower than the set temperature by 0.5 [° C.] (step S107, YES), the blowing temperature controller 11 starts the floor blowing control in which the blowing temperature is sequentially controlled on the basis of, for example, the upper limit temperature of the blowing temperature corresponding to the lower part temperature of the space S during the heating operation in the low-load mode shown in FIG. 4, and the information indicating the lower part temperature of the space S periodically (for example, every 5 seconds) input from the remote thermo-sensor 15 (step S108).

Next, the blowing temperature controller 11 continues the floor blowing control in the low-load mode until the lower part temperature of the space S that is periodically (for example, every 5 seconds) input from the remote thermo-sensor 15 reaches the set temperature based on the information indicating the set temperature instruction (step S110).

In the meantime, if the blowing temperature controller 11 receives an input of the information indicating the operation end instruction (step S109, YES), the blowing temperature controller 11 ends the floor blowing control (step S111). As described above, the operation of the floor blowing indoor unit 10 shown in the flowchart of FIG. 5 ends.

When the lower part temperature of the space S that is periodically (for example, every 5 seconds) input from the remote thermo-sensor 15 has reached the set temperature (step S110, YES), the blowing temperature controller 11 temporarily stops the floor blowing control (step S105). The blowing temperature controller 11 repeats the operations after step S106 described above.

Figure 6:
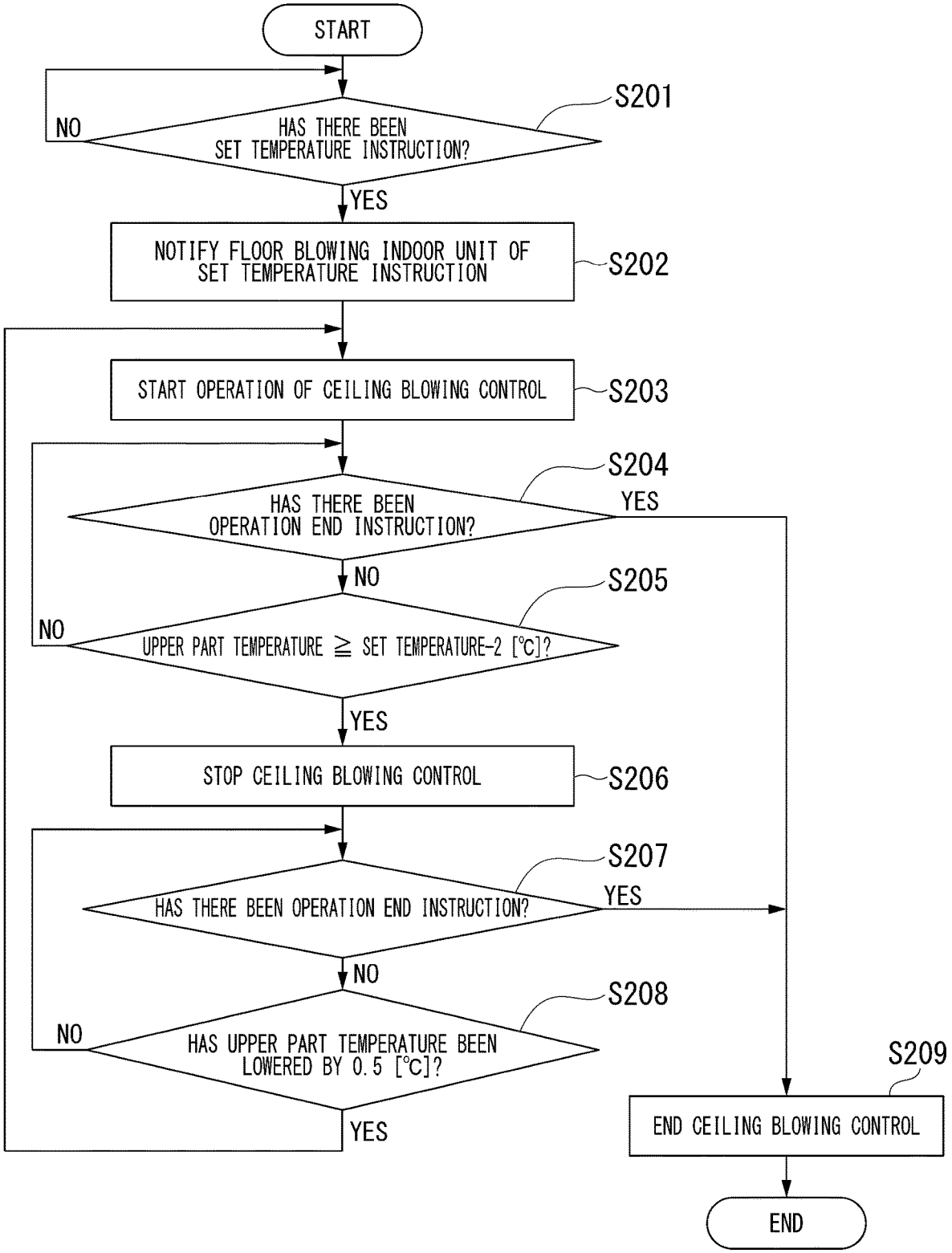
FIG. 6 is a flowchart showing an operation of a ceiling blowing indoor unit 20-1 of the embodiment.

Next, an example of an operation of the ceiling blowing indoor unit 20-1 will be described below. FIG. 6 is a flowchart showing an operation of the ceiling blowing indoor unit 20-1 of the embodiment. The operation of the ceiling blowing indoor unit 20-1 shown in the flowchart of FIG. 6 is started when, for example, power of the air conditioning system 1 is turned on. Furthermore, since an operation of the ceiling blowing indoor unit 20-2 is basically the same as the operation of the ceiling blowing indoor unit 20-1 to be described below, description thereof will be omitted.

The ceiling blowing indoor unit 20-1 waits for an input of information indicating a set temperature instruction (step S201). As described above, the set temperature instruction refers to an instruction received by an operation input of the user to the remote controller 25 for controlling the temperature inside the space S to a desired set temperature. The information indicating the set temperature instruction is input from, for example, the remote controller 25.

When the ceiling blowing indoor unit 20-1 receives an input of the information indicating the set temperature instruction (step S201, YES), the ceiling blowing indoor unit 20-1 notifies the floor blowing indoor unit 10, the ceiling blowing indoor unit 20-2, and the outdoor unit 30 of the information indicating the set temperature instruction (step S202).

Next, the ceiling blowing indoor unit 20-1 starts ceiling blowing control for controlling the upper part temperature of the space S on the basis of the upper part temperature of the space S estimated on the basis of a temperature measured by the suction temperature sensor 21 and the set temperature set by the user (step S203).

Next, the ceiling blowing indoor unit 20-1 continues the ceiling blowing control until the upper part temperature of the space S estimated on the basis of the temperature measured by the suction temperature sensor 21 reaches a temperature lower than the set temperature based on the information indicating the set temperature instruction by 2 [° C.] (step S205).

In the meantime, if the ceiling blowing indoor unit 20-1 receives an input of information indicating an operation end instruction (step S204, YES), the ceiling blowing indoor unit 20-1 ends the ceiling blowing control (step S209). As described above, the operation of the ceiling blowing indoor unit 20-1 shown in the flowchart of FIG. 6 ends. As described above, the operation end instruction refers to, for example, an instruction received by an operation input of the user to the remote controller 25 for turning off power of the air conditioning system 1.

When the upper part temperature of the space S estimated on the basis of the temperature measured by the suction temperature sensor 21 has reached the temperature lower than the set temperature by 2 [° C.] (step S205, YES), the ceiling blowing indoor unit 20-1 temporarily stops the ceiling blowing control (step S206).

Next, the ceiling blowing indoor unit 20-1 maintains a state in which the ceiling blowing control is temporarily stopped until the upper part temperature of the space S estimated on the basis of the temperature measured by the suction temperature sensor 21 reaches a temperature that is even lower by 0.5 [° C.] from the temperature lower than the set temperature by 2 [° C.] (that is, the upper part temperature reaches a temperature lower than the set temperature by 2.5 [° C.]) (step S208).

In the meantime, if the ceiling blowing indoor unit 20-1 receives an input of the information indicating the operation end instruction (step S207, YES), the ceiling blowing indoor unit 20-1 ends the ceiling blowing control (step S209). As described above, the operation of the ceiling blowing indoor unit 20-1 shown in the flowchart of FIG. 6 ends.

When the upper part temperature of the space S estimated on the basis of the temperature measured by the suction temperature sensor 21 has reached a temperature that is even lower by 0.5 [° C.] from the temperature lower than the set temperature by 2 [° C.] (step S208, YES), the ceiling blowing indoor unit 20-1 resumes the ceiling blowing control that controls the upper part temperature of the space S on the basis of the upper part temperature of the space S estimated on the basis of the temperature measured by the suction temperature sensor 21 and the set temperature set by the user (step S203). The ceiling blowing indoor unit 20-1 repeats the operations after step S204 described above.

Hereinafter, in order to make it easier to understand the above-described operations of the floor blowing indoor unit 10 and the ceiling blowing indoor unit 20, and an effect when these are used together, a specific example will be described.

For example, it is assumed that the upper part temperature in the space S is 18[° C.] and the lower part temperature is 16 [° C.]. In such an environment, it is assumed that, for example, the user uses the remote controller 25 to turn on power of the air conditioning system 1 and set the set temperature to 24 [° C.].

In this case, the blowing temperature controller 11 of the floor blowing indoor unit 10 recognizes that the blowing temperature corresponding to the lower part temperature of 16 [° C.] is 26 [° C.] on the basis of the upper limit line of the blowing temperature in the high-load mode shown in FIG. 3. The blowing temperature controller 11 controls the blowing temperature of the air blown out from the blowing outlet 50 to be 26 [° C.].

Also, the blowing temperature controller 11 controls the blowing temperature to be changed according to a change in the lower part temperature on the basis of the upper limit line of the blowing temperature in the high-load mode shown in FIG. 3. That is, the blowing temperature controller 11 increases the blowing temperature in accordance with a rise in the lower part temperature until the lower part temperature reaches 20 [° C.]. As shown in FIG. 3, at a time point at which the lower part temperature has reached 20 [° C.], the blowing temperature is controlled to be 30 [° C.].

Thereafter, the blowing temperature controller 11 controls the blowing temperature to be a constant temperature of 30 [° C.] until the lower part temperature reaches the set temperature of 24 [° C.]. The blowing temperature controller 11 temporarily stops the floor blowing control when the lower part temperature has reached 24 [° C.].

Thereafter, the lower part temperature decreases, and when the lower part temperature measured by the remote thermo-sensor 15 has reached 23.5 [° C.] which is lower than the set temperature of 24 [° C.] by 0.5 [° C.], the blowing temperature controller 11 resumes the floor blowing control.

At this time, the blowing temperature controller 11 controls the blowing temperature to be changed according to the change in the lower part temperature on the basis of the upper limit line of the blowing temperature in the low-load mode shown in FIG. 4. That is, at the beginning when the floor blowing control is resumed, the blowing temperature controller 11 controls the blowing temperature to be 26.7 [° C.] which is the blowing temperature corresponding to a case in which the lower part temperature is 23.5 [° C.].

Again, the blowing temperature controller 11 changes the blowing temperature in accordance with a rise in the lower part temperature until the lower part temperature measured by the remote thermo-sensor 15 reaches the set temperature of 24 [° C.]. As shown in FIG. 4, at a time point at which the lower part temperature reaches 24 [° C.] and blowing from the floor is temporarily stopped again, the blowing temperature is controlled to be 26.5 [° C.].

On the other hand, the ceiling blowing indoor unit 20 starts the ceiling blowing control with a target of bringing the upper part temperature of the space S to 22 [° C.] which is a temperature lower than the set temperature of 24 [° C.] by 2 [° C.]. The ceiling blowing indoor unit 20 temporarily stops the ceiling blowing control when the upper part temperature has reached 22 [° C.]. Thereafter, the upper part temperature decreases, and when the upper part temperature of the space S has reached 21.5 [° C.] which is even lower than the set temperature of 22 [° C.] by 0.5 [° C.], the ceiling blowing indoor unit 20 resumes the ceiling blowing control.

Furthermore, generally, it is expected that the lower part temperature has not reached 24 [° C.] at a time point at which the upper part temperature has reached 22 [° C.]. Therefore, after the upper part temperature reaches 22 [° C.] and the heating operation of the ceiling blowing indoor unit 20 is stopped, it becomes a state in which the heating operation is performed by the floor blowing indoor unit 10 alone.

As described above, when the system is started, the air conditioning system 1 of the present embodiment performs the heating operation with all units using the floor blowing indoor unit 10 and the ceiling blowing indoor unit 20. Therefore, the temperature inside the space S is quickly raised to a temperature close to the set temperature. Then, the air conditioning system 1 stops the ceiling blowing indoor unit 20 at a time point at which the upper part temperature has risen to a temperature lower than the set temperature by 2 [° C.], and switches to a heating operation using only the floor blowing indoor unit 10. Thereafter, the temperature inside the space S is controlled only by the heating operation of the floor blowing indoor unit 10 if it is within a controllable range by the floor blowing indoor unit 10.

Also, the air conditioning system 1 of the present embodiment finely controls the blowing temperature at low load (for example, at a time other than when the system is started) compared to a case at high load, and thereby comfort can be further improved.

According to the embodiment described above, an air conditioning system includes a first indoor unit and a second indoor unit. The first indoor unit controls a temperature of the inside of a space by controlling blowing of warm air from an upper part of the space to the inside of the space. The second indoor unit controls blowing of warm air from under a floor of the space to the inside of the space on the basis of a temperature in a lower part of the space.

For example, the air conditioning system described above is the air conditioning system 1 of the embodiment, the first indoor unit is the ceiling blowing indoor unit 20 of the embodiment, the second indoor unit is the floor blowing indoor unit 10 of the embodiment, the space is the space S of the embodiment, the temperature inside the space is the upper part temperature of the embodiment, and the temperature in the lower part of the space is the lower part temperature of the embodiment.

With such a configuration, the air conditioning system of the embodiment can reduce a temperature difference between the temperature in the lower part and the temperature in the upper part in the space. Therefore, the air conditioning system can raise a temperature around the feet of the person in the room and can create a thermal environment that makes the person in the room feel comfortable while the temperature in the upper part in the space is at a relatively lower temperature. Therefore, the air conditioning system of the embodiment can lower the set temperature (for example, lower temperature by 2 [° C.]) while maintaining comfort, and thereby energy consumption can be reduced.

Also, since the air conditioning system of the embodiment is not a system in which air conditioners of different systems are combined as, for example, in the conventional technologies described above, the system can be easily introduced without needing large-scale system construction.

As described above, the air conditioning system of the embodiment can achieve improvement in comfort with a simpler system configuration.

Furthermore, the second indoor unit may include a blowing temperature controller that controls a blowing temperature of the warm air on the basis of an upper limit temperature determined for each temperature in the lower part of the space. For example, the blowing temperature controller described above is the blowing temperature controller 11 in the embodiment.

Furthermore, the blowing temperature controller may be configured to control the blowing temperature on the basis of the upper limit temperature that is different according to whether or not it is at the time of starting. For example, the above-described upper limit temperature that is different according to whether or not it is at the time of starting corresponds to the line of the upper limit temperature shown in FIGS. 3 and 4 in the embodiment.

Furthermore, the first indoor unit may be configured to control the temperature of the inside of the space to be a temperature lower than a designated set temperature by a predetermined amount of temperature. For example, the predetermined amount of temperature described above is 2 [° C.] in the embodiment.

Furthermore, a temperature sensor that measures a temperature in the lower part of the space may be further provided, and the second indoor unit may be configured to control blowing of warm air on the basis of the temperature measured by the temperature sensor. For example, the temperature sensor described above is the remote thermo-sensor 15 in the embodiment.

A part of the air conditioning system 1 of the above-described embodiment may be realized by a computer. In that case, a program for realizing these functions may be recorded on a computer-readable recording medium and realized by causing a computer system to read and execute the program recorded on the recording medium. Furthermore, the "computer system" described herein includes an operating system (OS) and a hardware such as peripherals. Also, the "computer-readable recording medium" refers to a portable medium such as a flexible disk, a magneto-optical disk, a read-only memory (ROM), or a compact disc read-only memory (CD-ROM), and a storage device such as a hard disk built in the computer system. Furthermore, the "computer-readable recording medium" may include one that holds a program dynamically for a short period of time such as a communication line in a case in which programs are transmitted via a network such as the Internet or a communication line such as a telephone line, and one that holds a program for a certain period of time such as volatile memories inside a computer system serving as a server or client in the above-described case. Furthermore, the above-described program may be a program for realizing some of the above-described functions, further may be a program for realizing the above-described functions in combination with programs already recorded on the computer system, and may be realized by using hardware such as a programmable logic device (PLD), a field programmable gate array (FPGA), or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioning system provided in a building, the building including a floor having blowing outlets, a ceiling, and a side wall, the building having a space surrounded by the floor, the ceiling, and the side wall, the space having a lower space closer to the floor than the ceiling, the air conditioning system comprising:

a first indoor unit configured to blow ceiling warm air from the ceiling to an inside of the space, the first indoor unit being configured to control a temperature of the inside of the space by controlling the blowing of the ceiling warm air, the first indoor unit including a suction temperature sensor configured to measure a suction temperature of air suctioned into the first indoor unit;

a remote thermo-sensor installed on the side wall, the remote thermo-sensor being configured to measure a lower part temperature at a position in the lower space;

a second indoor unit configured to blow floor warm air to the inside of the space from the blowing outlets based on the lower part temperature measured by the remote thermo-sensor, the second indoor unit being configured to control the blowing of the floor warm air;

an outdoor unit including a compressor; and a refrigerant pipe connecting the first indoor unit, the second indoor unit, and the outdoor unit, the refrigerant pipe connecting the first indoor unit and the second indoor unit in parallel, wherein the second indoor unit controls a blowing temperature of the floor warm air to be blown into the space from the blowing outlets in different operation modes, including a high-load mode and a low-load mode, which are different from each other depending on whether the air conditioning system is at a low load or at a high load, in the high-load mode, the blowing temperature of the floor warm air is controlled based on a first upper limit temperature of the blowing temperature, and the first upper limit temperature is a temperature obtained by adding 10° C. to the lower part temperature, and in the low-load mode, the blowing temperature of the floor warm air is controlled based on the first upper limit temperature of the blowing temperature until the lower part temperature reaches a predetermined temperature and thereafter, when the lower part temperature is above the predetermined temperature, the blowing temperature of the floor warm air is controlled based on a second upper limit temperature of the blowing temperature, and the second upper limit temperature is different from the first upper limit temperature.

2. The air conditioning system according to claim 1, wherein the second indoor unit comprises a blowing temperature controller configured to control the blowing temperature of the floor warm air on the basis of the first upper limit temperature or the second upper limit temperature.

3. The air conditioning system according to claim 2, wherein the blowing temperature controller is configured to control the blowing temperature on the basis of the first upper limit temperature or the second upper limit temperature according to whether or not the air conditioning system is being started.

4. The air conditioning system according to claim 1, wherein the first indoor unit is configured to control the temperature of the inside of the space to be a temperature lower than a designated set temperature by a predetermined amount of temperature.

5. The air conditioning system according to claim 1, wherein in the low-load mode and after the lower part temperature reaches the predetermined temperature, the blowing temperature decreases until the lower part temperature reaches a second predetermined temperature.

6. A floor blowing air conditioner provided in an air conditioning system in a building, the building including a floor having blowing outlets, a ceiling, and a side wall, the building having a space surrounded by the floor, the ceiling, and the side wall, the space having a lower space closer to the floor than the ceiling, the floor blowing air conditioner being configured to blow floor warm air to an inside of the space from the blowing outlets, the floor blowing air conditioner comprising a blowing temperature controller configured to control a blowing temperature of the floor warm air blown out from the blowing outlets to the inside of the space on the basis of a lower part temperature at a position in the lower space, wherein the blowing temperature controller controls the blowing temperature of the floor warm air to be blown into the space from the blowing outlets in different operation modes, including a high-load mode and a low-load mode, which are different from each other depending on whether the air conditioning system is at a low load or at a high load, in the high-load mode, the blowing temperature of the floor warm air is controlled based on a first upper limit temperature of the blowing temperature, and the first upper limit temperature is a temperature obtained by adding 10° C. to the lower part temperature, and in the low-load mode, the blowing temperature of the floor warm air is controlled based on the first upper limit temperature of the blowing temperature until the lower part temperature reaches a predetermined temperature and thereafter, when the lower part temperature is above the predetermined temperature, the blowing temperature of the floor warm air is controlled based on a second upper limit temperature of the blowing temperature, and the second upper limit temperature is different from the first upper limit temperature.

7. A control method of an air conditioning system, the air conditioning system being provided in a building, the building including a floor having blowing outlets, a ceiling, and a side wall, the building having a space surrounded by the floor, the ceiling, and the side wall, the space having a lower space closer to the floor than the ceiling, the air conditioning system comprising a first indoor unit, a remote thermo-sensor, a second indoor unit, an outdoor unit, and a refrigerant pipe, the first indoor unit being configured to blow ceiling warm air from the ceiling to an inside of the space, the first indoor unit being configured to control a temperature of the inside of the space by controlling the blowing of the ceiling warm air, the first indoor unit including a suction temperature sensor configured to measure a suction temperature of air suctioned into the first indoor unit, the remote thermo-sensor installed on the side wall, the remote thermo-sensor being configured to measure a lower part temperature at a position in the lower space, the second indoor unit configured to blow floor warm air to the inside of the space from the blowing outlets on the basis of the lower part temperature measured by the remote thermo-sensor, the second indoor unit being configured to control the blowing of the floor warm air, the outdoor unit including a compressor, and the refrigerant pipe connecting the first indoor unit, the second indoor unit, and the outdoor unit, the refrigerant pipe connecting the first indoor unit and the second indoor unit in parallel, the control method comprising:

a step of, by the first indoor unit, controlling a temperature of the inside of the space by controlling the blowing of the ceiling warm air to the inside of the space; and a step of, by the second indoor unit, controlling the blowing of the floor warm air from the blowing outlets to the inside of the space on the basis of the lower part temperature, wherein in the step of controlling the blowing of the floor warm air, the second indoor unit controls a blowing temperature of the floor warm air to be blown into the space from the blowing outlets in different operation modes, including a high-load mode and a low-load mode, which are different from each other depending on whether the air conditioning system is at a low load or at a high load, in the high-load mode, the blowing temperature of the floor warm air is controlled based on a first upper limit temperature of the blowing temperature, and the first upper limit temperature is a temperature obtained by adding 10° C. to the lower part temperature, and in the low-load mode, the blowing temperature of the floor warm air is controlled based on the first upper limit temperature of the blowing temperature until the lower part temperature reaches a predetermined temperature and thereafter, when the lower part temperature is above the predetermined temperature, the blowing temperature of the floor warm air is controlled based on a second upper limit temperature of the blowing temperature, and the second upper limit temperature is different from the first upper limit temperature.

8. A computer-readable non-transitory storage medium storing a program for a computer of an air conditioning system, the air conditioning system being provided in a building, the building including a floor having blowing outlets, a ceiling, and a side wall, the building having a space surrounded by the floor, the ceiling, and the side wall, the space having a lower space closer to the floor than the ceiling, the air conditioning system comprising a first indoor unit, a remote thermo-sensor, a second indoor unit, an outdoor unit, and a refrigerant pipe the first indoor unit being configured to blow ceiling warm air from the ceiling to an inside of the space, the first indoor unit being configured to control a temperature of the inside of the space by controlling the blowing of the ceiling warm air, the first indoor unit including a suction temperature sensor configured to measure a suction temperature of air suctioned into the first indoor unit, the remote thermo-sensor installed on the side wall, the remote thermo-sensor being configured to measure a lower part temperature at a position in the lower space, the second indoor unit configured to blow floor warm air to the inside of the space from the blowing outlets based on the lower part temperature measured by the remote thermo-sensor, the second indoor unit being configured to control the blowing of the floor warm air, the outdoor unit including a compressor, and the refrigerant pipe connecting the first indoor unit, the second indoor unit, and the outdoor unit, the refrigerant pipe connecting the first indoor unit and the second indoor unit in parallel, the program causing the computer of the air conditioning system to execute:

a step of causing the first indoor unit to control a temperature of the inside of the space by controlling the blowing of the ceiling warm air from the ceiling to the inside of the space; and a step of causing the second indoor unit to control the blowing of the floor warm air from the blowing outlets to the inside of the space on the basis of the lower part temperature, wherein in the step of controlling the blowing of the floor warm air, the second indoor unit controls a blowing temperature of the floor warm air to be blown into the space from the blowing outlets in different operation modes, including a high-load mode and a low-load mode, which are different from each other depending on whether the air conditioning system is at a low load or at a high load, in the high-load mode, the blowing temperature of the floor warm air is controlled based on a first upper limit temperature of the blowing temperature, and the first upper limit temperature is a temperature obtained by adding 10° C. to the lower part temperature, and in the low-load mode, the blowing temperature of the floor warm air is controlled based on the first upper limit temperature of the blowing temperature until the lower part temperature reaches a predetermined temperature and thereafter, when the lower part temperature is above the predetermined temperature, the blowing temperature of the floor warm air is controlled based on a second upper limit temperature of the blowing temperature, and the second upper limit temperature is different from the first upper limit temperature.

* * * * *